US005389005A

United States Patent [19]

Kodama

[11] Patent Number: 5,389,005

[45] Date of Patent: Feb. 14, 1995

[54] WATERPROOF ELECTRIC CONNECTOR SEAL MEMBER

[75] Inventor: Shinji Kodama, Shizuoka, Japan

[73] Assignee: Yazaki Corporation, Tokyo, Japan

[21] Appl. No.: 259,507

[22] Filed: Jun. 14, 1994

[30] Foreign Application Priority Data

Jun. 22, 1993 [JP] Japan ..... 5-150274

[51] Int. Cl.[6] ..... H01R 13/52

[52] U.S. Cl. ..... 439/272; 439/282

[58] Field of Search ..... 439/271, 277, 272, 281, 439/282, 273, 278

[56] References Cited

U.S. PATENT DOCUMENTS

| | | | |
|---|---|---|---|
| 4,611,872 | 9/1986 | Ito et al. | 439/277 |
| 4,874,325 | 10/1989 | Bensing et al. | 439/272 |
| 4,940,420 | 7/1990 | Munie | 439/272 |

FOREIGN PATENT DOCUMENTS

| | | | |
|---|---|---|---|
| 61-179077 | 8/1986 | Japan . | |
| 1-73772 | 5/1989 | Japan . | |
| 4315780 | 11/1992 | Japan | 439/271 |
| 2243959 | 11/1991 | United Kingdom | 439/271 |

*Primary Examiner*—William Briggs
*Attorney, Agent, or Firm*—Heslin & Rothenberg

[57] ABSTRACT

A waterproof electric connector seal member includes a rubber-formed seal element having a rectangular tubular section and plastic-formed tongues fixed to a flange portion of the seal element. The seal member is retained in an electric connector housing via the tongues. Thus, although the shape of the seal element varies depending upon the number of terminals accommodated within the electric connector, the standard-shaped tongues can be commonly used.

10 Claims, 5 Drawing Sheets

WATERPROOF ELECTRIC CONNECTOR SEAL MEMBER

BACKGROUND OF THE INVENTION

1. Field of the Invention

The present invention relates to an improvement in a seal member for water-tightly sealing male and female electric connector housings to each other.

2. Description of the Prior Art

Conventionally, a waterproof electric connector seal member is formed by covering an annular seal holder on the outer periphery of a flange portion placed at the end of the tubular seal member formed of elastic synthetic rubber. The annular seal holder is formed of a synthetic resin material which is harder than the tubular seal member and two tongues are integrally formed to protrude from the outer peripheral surface of the annular seal holder in the two positions oppositely facing each other with respect to the axis of the electric connectors. Within a male electric connector housing, a flexible arm having an inwardly-protruding retaining shoulder at the forward end thereof is formed in a position corresponding to each of the tongues on the annular seal holder.

When such a tubular seal member is being inserted into the male electric connector housing, the tongues on the annular seal holder abut against the retaining shoulders of the flexible arms which are then resiliently deformed so as to permit the tongues to pass through the retaining shoulders. Then, when the tubular seal member is fully inserted into the male electric connector housing, the flexible arms resiliently return to their original shape so that the shoulders can retain the tongues. Subsequently, when a female electric connector housing is inserted into the male electric connector housing, the tubular seal member is pressurized to be elastically deformed and accordingly to closely contact the wall of the male electric connector housing, thus sealing the gap between the male and female electric connector housings.

The shape of the electric connector housings varies depending upon the number of terminals accommodated therein and placed in parallel to each other. When the number of terminals is small, the lateral width of the electric connector housing becomes narrow. On the other hand, when the number of terminals placed in parallel to each other increases, the accommodating connector housing has greater length and width dimensions, or it is formed in a rectangular shape having a great lateral width. It is thus necessary to manufacture respective tubular seal members adaptable to electric connectors which are variously shaped depending upon the number of terminals and, in addition, it is further necessary to manufacture annular seal holders adaptable to such variously-shaped tubular seal members.

SUMMARY OF THE INVENTION

Accordingly, an object of the present invention is to provide a waterproof electric connector seal member which minimizes the material cost of the annular seal holder and also enables the common use of the annular seal holder regardless of the number of terminals accommodated within the male and female electric connector housings.

In order to achieve the above object, the present invention provides a waterproof electric connector seal member comprising: an elastic seal element fit around the outer periphery of a housing portion within a hood of a male electric connector housing, formed of a tubular portion and a flange portion in a tubular section so as to seal the gap between the male electric connector housing and a female electric connector housing which abuts against the outer periphery of the tubular portion so as to be inserted into the hood of the male electric connector housing; and tongues harder than the seal element, fixed to a plurality of portions on the outer periphery of the flange portion of the seal element so as to protrude from the outer periphery of the flange portion, the tongues being retained by means of flexible arms arranged within the hood of the male electric connector housing, placed in the positions corresponding to the tongues when the seal element is fully inserted so as to abut against a wall of the male electric connector housing.

The tongues of the seal element may be formed in the identical section so that they can be commonly used compatible for variously-shaped seal elements resulting from various lateral widths depending upon the number of terminals accommodated within electric connectors. Such tongues may be securely fit into slots formed on the flange portion of the seal element.

According to the seal member constructed as described above, hard tongues retained by means of flexible arms arranged in the hood of the male electric connector housing can substitute for an annular seal holder of a conventional waterproof electric connector seal member. Thus, the shape of the tongues can be standardized regardless of the shape of the seal element which varies depending upon the number of terminals accommodated within the electric connectors. Such tongues can be commonly used for variously-shaped seal elements, thus minimizing the material costs.

When the female electric connector housing is inserted into the hood of the male electric connector housing, the seal element is pressurized by the female electric connector housing so as to be elastically deformed and accordingly to closely contact the outside of the male electric connector housing, thus water-tightly sealing the gap between the male and female electric connector housings by the seal member.

Further objects, advantages and novel features of the present invention will be described in detail with reference to the accompanying drawings.

DESCRIPTION OF THE PREFERRED EMBODIMENTS

Figure 1:
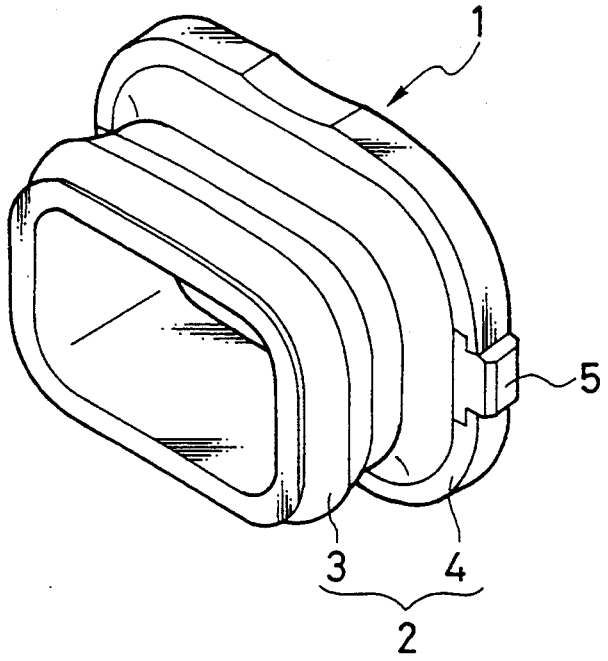
FIG. 1 is a perspective view of a seal member according to the present invention.

As shown in FIG. 1, a waterproof electric connector seal member generally denoted by 1 of the present invention comprises a seal element 2 and tongues 5. The seal element 2 includes a tubular portion 3 in a generally rectangular tubular section and a flange portion 4 continuously extending from the tubular portion 3. The two portions are integrally formed by an elastic material such as rubber, or the like. Two tongues 5 formed of a plastic material which is harder than the seal element 2 are embedded and fixed into the flange portion 4 so as to be placed oppositely facing each other with respect to the center axis of the opening of the seal member 1. The tongues 5 protrude from the outer periphery of the flange portion 4 so as to serve the function of retaining the seal element 2 in an electric connector housing.

Figure 2:
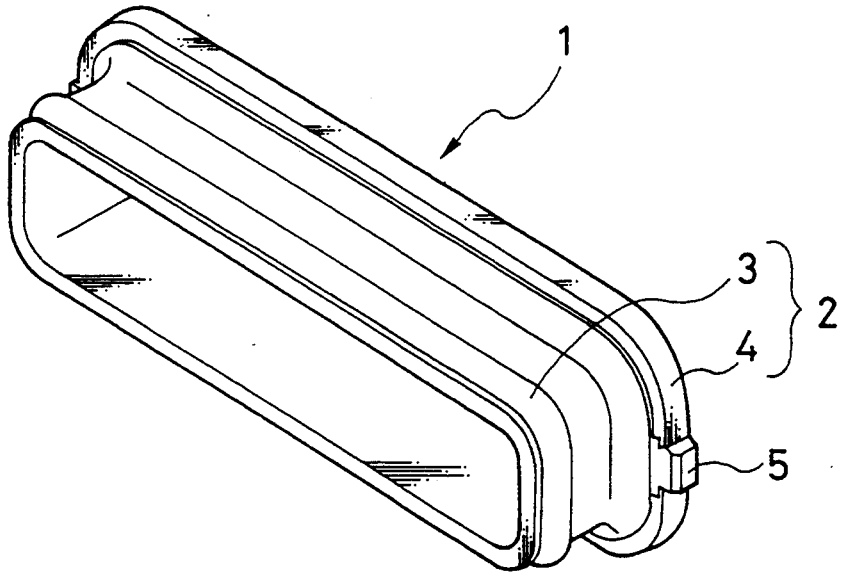
FIG. 2 is a perspective view of a seal member for a multi-terminal electric connector according to the present invention.

Since the seal member 1 comprises the seal element 2 and the tongues 5 as described above, the retaining tongues 5 can be commonly used for a relatively small seal member 1 shown in FIG. 1 and also for a great width seal member 1 for multi-terminal electric connector illustrated in FIG. 2, by defining the standard shape of the tongues 5.

For fixing the tongues 5 to the flange portion 4 of the seal element 2, an adhesive is first applied to the tongues 5 which are then fit into slots adapted to the profile of the tongues in predetermined positions of the flange portion 4. Alternatively, when the seal element 2 is molded, the tongues 5 may be embedded into the flange portion 4.

Figure 3:
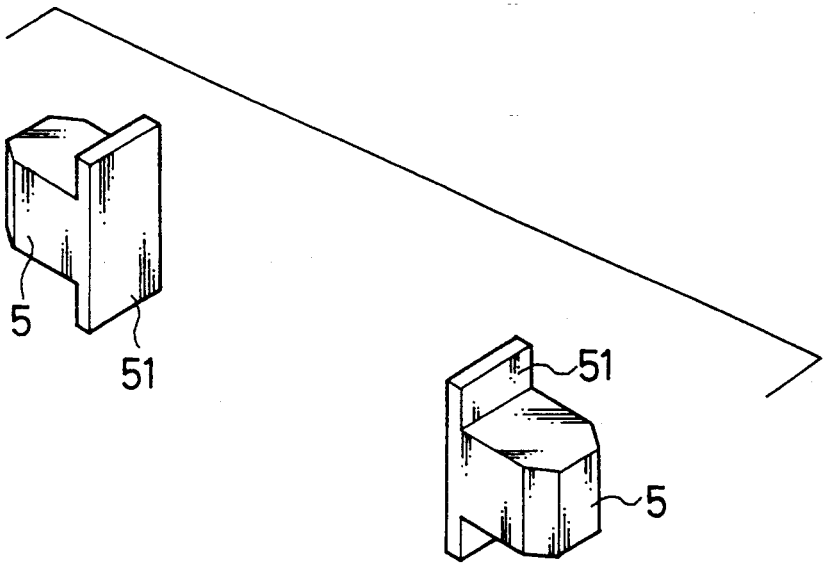
FIG. 3 is a perspective view of tongues according to the present invention.
Figure 4:
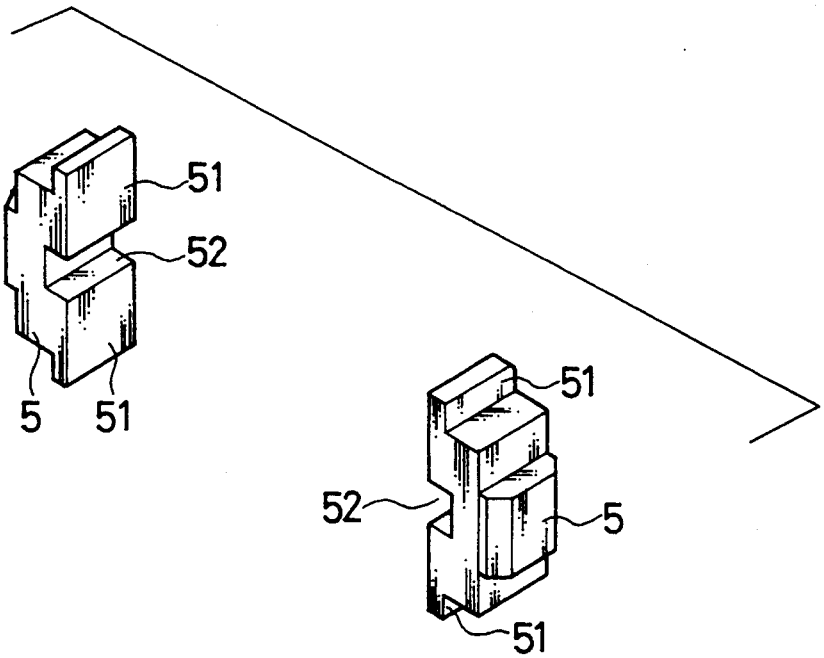
FIG. 4 is a perspective view of another embodiment of tongues according to the present invention.

No matter which method of fixing the tongues 5 to the flange portion 4 is employed, in order to avoid the separation therebetween, it is preferable that each of the tongues 5 be formed in a T-shape section so as to provide an embedding seat 51, as shown in FIG. 3, or the embedding seat be further provided with a recess 52 so as to be formed in a zigzag shape, as illustrated in FIG. 4, thus enlarging the contact area between the tongues 5 and the flange portion 4.

Figure 5:
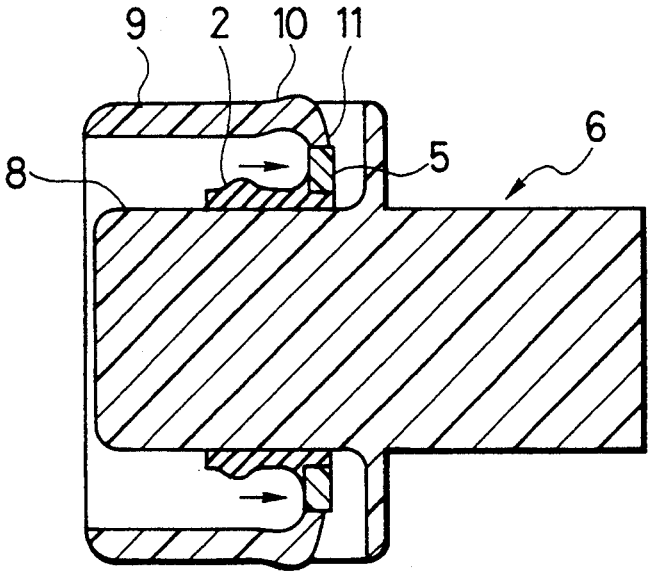
FIG. 5 is a sectional view of the seal member according to the present invention being inserted into a male electric connector housing.
Figure 6:
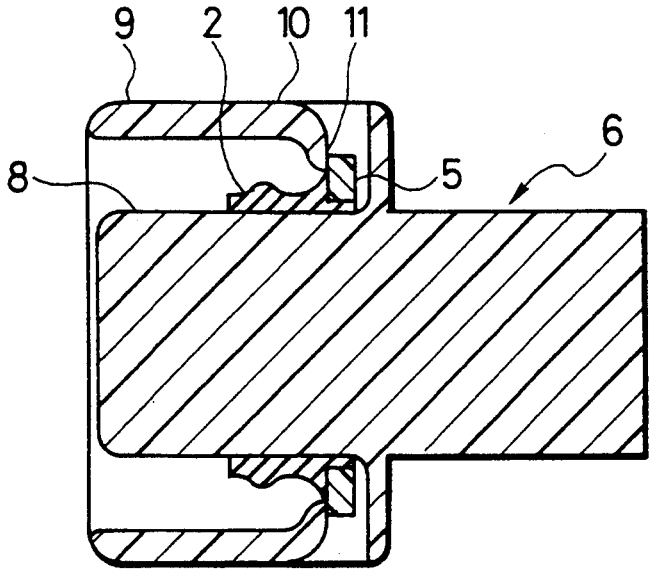
FIG. 6 is a sectional view of the seal member shown in FIG. 5 fully inserted into the housing and retained by means of elastic arms.
Figure 7:
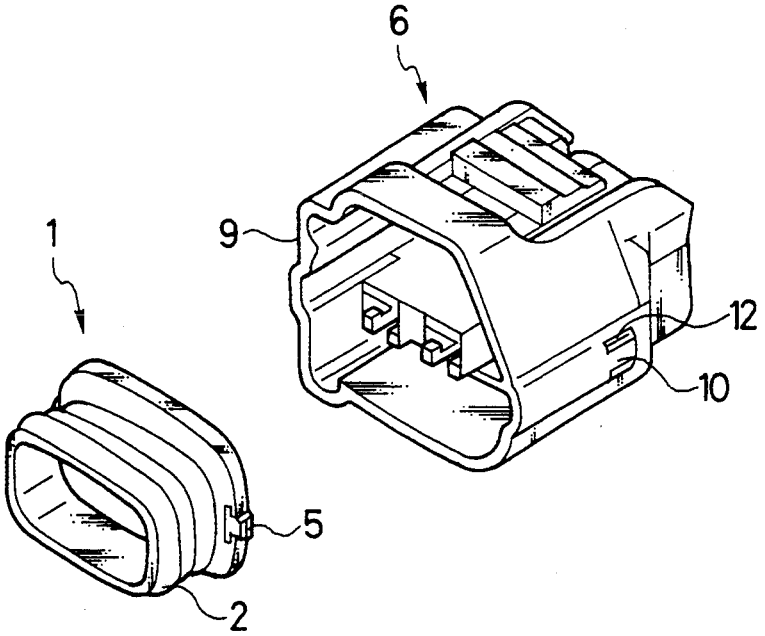
FIG. 7 is a perspective view of the male electric connector housing before the seal member illustrated in FIG. 1 is inserted thereinto.

FIGS. 5 and 6 illustrate a procedure for inserting the seal member 1 into the male electric connector housing so as to be retained in the housing. FIG. 7 shows the male electric connector housing 6 and the seal member 1 before being inserted thereinto. As illustrated in FIG. 5, as the seal member 1 is being fit around the outer periphery of a housing portion 8 used for a terminal accommodating chamber within a hood 9 of the male electric connector housing 6 and further axially pushed thereinto, each of the tongues 5 abuts against a shoulder 11 formed on the forward end of a cantilever flexible arm 10 which is arranged in the hood 9 corresponding to the position of each of the tongues 5 fixed to the flange portion 4 of the seal element 2. When the seal element 2 is further pushed into the housing 6, the flexible arms 10 are resiliently deformed outwardly as shown in FIG. 5 so as to permit the tongues 5 to pass through the shoulders 11. When the seal element 2 is fully inserted into the housing 6, as illustrated in FIG. 6, the tongues 5 pass through the shoulders 11 of the flexible arms 10 which then return to their original shape, thus retaining the seal element 2 by the housing portion 8 by means of the flexible arms 10 via the tongues 5.

Figure 8:
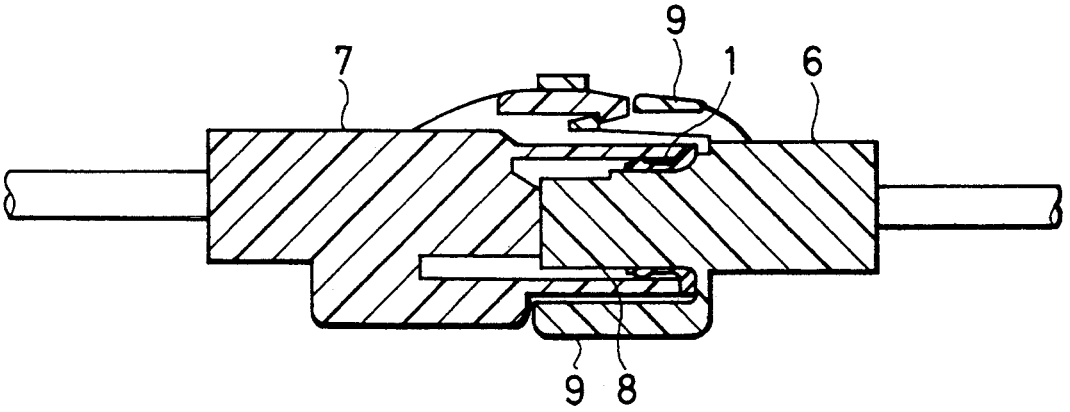
FIG. 8 is a longitudinal sectional view of the male electric connector housing illustrated in FIG. 7 and a female electric connector housing being connected to each other.

Subsequently, as shown in FIG. 8, when a female electric connector housing 7 is inserted into the hood 9 of the male electric connector housing 6, an annular protrusion of the seal element 2 is pressurized by the female electric connector housing 7 so as to bring the seal element 2 into a close contact with a wall of the housing portion 8 of the male electric connector housing 6, thereby water-tightly sealing the gap between the male and female connector housings.

Figure 9:
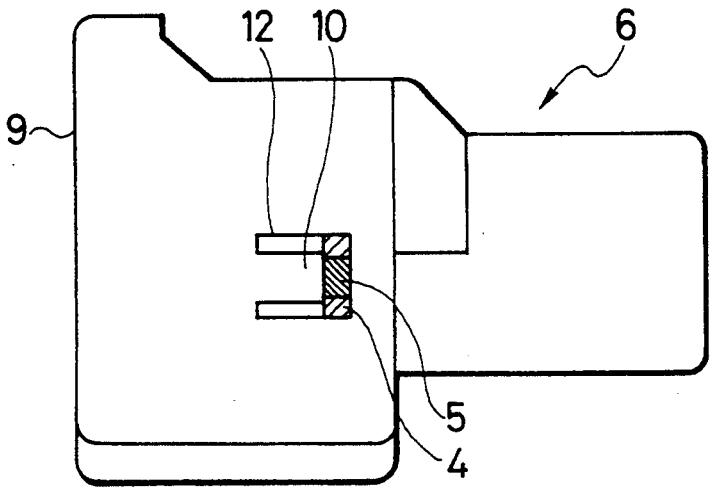
FIG. 9 is a side view of the male electric connector housing illustrated in FIG. 7 and shows a flexible arm for retaining the seal member according to the present invention.

FIG. 9 shows the lateral side of the male electric connector housing 6 illustrated in FIG. 7. A notch 12 is formed on each of the lateral sides of the hood 9 of the male electric connector housing 6 and each of the cantilever flexible arms 10 is formed in the notch 12 to continuously extend from the hood 9 toward the axis of the electric connector. The shoulder 11 is formed to protrude inward from the hood 9 at the forward end of each of the flexible arms 10. The tongues 5 of the seal member 1 are fixed to the periphery of the flange portion 4 to be placed corresponding to the positions of the respective flexible arms 10.

Figure 10:
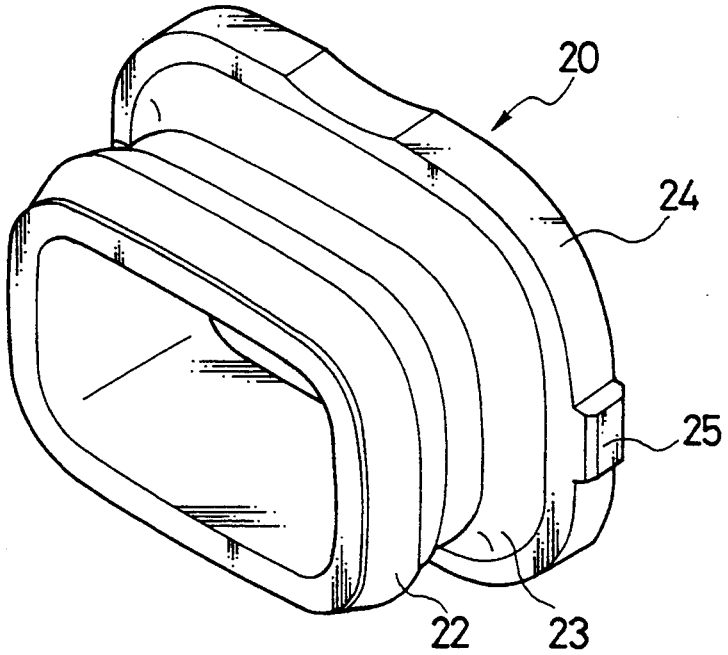
FIG. 10 PRIOR ART
FIG. 10 is a perspective view of a conventional seal member.

FIG. 10 shows a conventional waterproof electric connector seal member 20. A plastic-formed annular seal holder 24 harder than a rubber-formed seal element 22 is fixed to the periphery of a flange portion 23 placed at the end of the seal element 22. On the periphery of the annular seal holder 24, the two protruding tongues 25 are formed integrally with the annular seal holder 24 so as to be placed oppositely facing each other with respect to the axis of the opening of the seal member 20.

As will be clearly understood from the foregoing description, the present invention offers the following advantages.

Since the standard-shaped tongues can be commonly used for the seal members, it is necessary to manufacture only rubber-formed seal elements which are variously shaped depending upon the number of terminals of the electric connectors. Further, standard-shaped small tongues can be substituted for a rectangularly framed annular seal holder of a conventional seal member, thus permitting a reduction in the material costs.

What is claimed is:

1. A waterproof electric connector seal member for water-tightly engaging male and female electric connector housings with each other, said seal member comprising:

an elastic seal element fit around the outer periphery of a housing portion within a hood of said male electric connector housing, formed of a tubular portion and a flange portion in a tubular section so as to seal the gap between said male electric connector housing and a female electric connector housing which abuts against the outer periphery of said tubular portion so as to be inserted into said hood of said male electric connector housing; and tongues harder than said seal element, fixed to a plurality of portions on the outer periphery of said flange portion of said seal element so as to protrude from the outer periphery of said flange portion, said tongues being retained by means of flexible arms arranged within said hood of said male electric connector housing, placed corresponding to the respective positions of said tongues when said seal element is fully inserted so as to abut against a wall of said male electric connector housing.

2. A seal member according to claim 1, wherein said seal element has a generally rectangular tubular section adaptable to male and female electric connector housings.

3. A seal member according to claim 1, wherein the lateral width of said seal element varies depending upon the number of electric terminals accommodated in said male and female electric connectors.

4. A seal member according to claim 3, wherein said tongues for said seal element have the identical section so as to be commonly fixed to variously-shaped seal elements resulting from various lateral widths.

5. A seal member according to claim 4, wherein said tongues are securely fit into slots formed on said flange portion of said seal element.

6. A seal member according to claim 4, wherein said tongues are fixed to said flange portion of said seal element so as to be placed oppositely facing each other with respect to the axis of said electric connectors.

7. A seal member according to claim 5, wherein each of said tongues is formed in a T-shape section having an embedding seat.

8. A seal member according to claim 7, wherein said embedding seat is formed in a zigzag shape.

9. A seal member according to claim 1, wherein each of said flexible arms is formed in a cantilever-shape within a notch formed in said hood of said male electric connector housing so as to extend toward the axis of said electric connector.

10. A seal member according to claim 9, wherein each of said flexible arms has a shoulder inwardly protruding from the forward end thereof.

* * * * *